United States Patent [19]

Satake et al.

[11] Patent Number: 4,721,701

[45] Date of Patent: Jan. 26, 1988

[54] THERMOSENSITIVE RECORDING SHEET

[75] Inventors: Toshimi Satake; Toshiaki Minami; Tomoaki Nagai, all of Tokyo; Fumio Fujimura, Ohmiya, all of Japan

[73] Assignee: Jujo Paper Co., Ltd., Tokyo, Japan

[21] Appl. No.: 814,921

[22] Filed: Dec. 30, 1985

[30] Foreign Application Priority Data

Jan. 9, 1985 [JP] Japan ..... 60-1868
Jan. 17, 1985 [JP] Japan ..... 60-6515
Feb. 13, 1985 [JP] Japan ..... 60-25739

[51] Int. Cl.[4] ..... B41M 5/18

[52] U.S. Cl. ..... 503/209; 427/150; 427/151; 503/212; 503/216; 503/217; 503/221

[58] Field of Search ..... 346/212, 216, 217, 225, 346/208, 209; 427/150–152; 503/208, 209, 212, 216, 217, 220, 221, 224, 225

[56] References Cited

U.S. PATENT DOCUMENTS 3,871,900 3/1975 Hayaishi et al. ..... 346/212
3,934,070 1/1976 Kimura et al. ..... 346/212
4,514,745 4/1985 Suzuki et al. ..... 346/225

FOREIGN PATENT DOCUMENTS 0127189 7/1985 Japan ..... 346/209
0178086 9/1985 Japan ..... 346/209

*Primary Examiner*—Bruce H. Hess
*Attorney, Agent, or Firm*—Sherman and Shalloway

[57] ABSTRACT

A thermosensitive recording sheet having a thermosensitive color developing layer containing a basic leuco dye and an organic color developer, said organic color developer consisting of at least partly of a halogen-substituted benzoic acid zinc salt represented by the following general formula

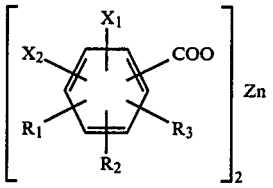

(I)

wherein $X_1$ represents a halogen atom, $X_2$ represents a hydrogen or halogen atom, and $R_1$, $R_2$ and $R_3$, independently from each other, represent a hydrogen atom or an alkyl, alkoxy, cycloalkyl, nitro, cyano or hydroxyl group.

19 Claims, No Drawings

THERMOSENSITIVE RECORDING SHEET

This invention relates to a thermosensitive recording sheet, and more specifically, to a thermosensitive recording sheet having excellent thermal response, resistance to soiling by oily substances such as hairdressing agents or oils and fats (oil resistance) and storage stability.

Thermosensitive recording sheets which utilize a coloring reaction under heat between a normally colorless or light-colored basic leuco dye and an organic color developer such as phenols and organic acids are disclosed, for example, in Japanese Patent Publication No. 14039/1970 and Japanese Laid-Open Patent Publication No. 27736/1973, and have gained widespread commercial acceptance. Generally, the thermosensitive recording sheets are obtained by grinding the colorless to light-colored basic leuco dye and the organic color developer into fine particles, mixing these particles, adding a binder, a filler, a sensitivity increasing agent, a lubricant and other auxiliary agents to the mixture to form a coating composition, and applying the coating composition in a thin layer to a support such as paper or a plastic film. The thermosensitive color developer layer forms a color imagewise by an instantaneous chemical reaction induced by heating and thereby permits recording of the image. Images of various colors can be obtained by properly selecting the type of the leuco dye.

These thermosensitive recording sheets have been finding applications, for example, in measuring and recording instruments in the medical or industrial field, terminal devices of computers and information communication devices, facsimile devices, printers of electronic portable calculators, and ticket vending machines.

Numerous substances have been described as color developers for thermosensitive recording sheets in the literature including Japanese Patent Publication No. 14039/1970. Among them, 4,4'-isopropylidene diphenol (i.e., bisphenol A) is now most widely used because of its quality, stability, cost and availability.

The thermosensitive recording sheets cannot avoid contact with human hands in view of their function as information recording media. Frequently, therefore, the fingers of persons who handle the sheet have adhering thereto oily substances such as hair-dressing agents used in every day lives or oils and fats contained in the sweat from the skin, and there are many occasions on which the thermosensitive recording sheets undrgo soiling or contamination by these oily substances. Generally, however, the thermosensitive recording sheets do not have sufficient stability to these soiling substances, and the density of the color image may be reduced or lost at a part soiled by such substances. Furthermore, soiling of the background portion often results in discoloration or coloration. The cause of this has not yet been fully elucidated, but presumably, it is because the oily substances partly dissolve, or render unstable, the color forming layer composed of the particulate basic leuco dye and the color developer or the color reaction product. The thermosensitive recording sheet described in Japanese Patent Publication No. 49037/1982 requires a pre-treatment step with the thermofusible substance, and this pre-treatment not only reduces the efficiency of production, but also makes it difficult to give a thermosensitive recording sheet of uniform quality.

It is an object of this invention to provide a thermosensitive recording sheet which by selecting a particular substance as a color developer in the presence or absence of a thermofusible substance, has a good thermal response, and gives a practical color image density, and in which recorded images have resistance to the adhesion of hair-dressing agents or oils and fats and exhibit excellent storage stability under high-humidity and high-temperature storage conditions.

Another object of this invention is to provide a thermosensitive recording sheet which has an excellent thermal response to a low thermal energy and gives a practical dynamic image density, and in which images recorded thereon have excellent storage stability and both the recorded images and the background portion have excellent moisture resistance, heat resistance and oil resistance.

Still another object of this invention is to provide a thermosensitive recording sheet in which by using a fluorene-type leuco dye, the readability of an image recorded on the sheet in the near infrared region is improved, and the recorded image is stable with time and also against the adhesion of oils and facts and retains its improved readability in the near infrared region, and which has excellent color formability in the visible region.

Other objects and advantages of this invention will become apparent from the following detailed description.

According to this invention, there is provided a thermosensitive recording sheet having a thermosensitive color developing layer containing a basic leuco dye and an organic color developer, said organic color developer consisting at least partly of a halogen-substituted benzoic acid zinc salt represented by the following general formula

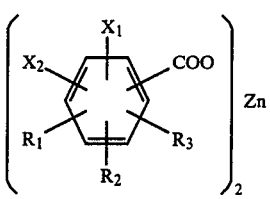

(I)

wherein $X_1$ respresents a halogen atom, $X_2$ represents a hydrogen or halogen atom, and $R_1$, $R_2$ and $R_3$, independently from each other, represent a hydrogen atom or an alkyl, alkoxy, cycloalkyl, nitro, cyano or hydroxyl group.

The basic characteristic feature of the thermosensitive recording sheet of this invention is that a particular halogen-substituted benzoic acid zinc salt of the above formula (I) is used as a main color developer. The zinc benzoates having 1 to 2 halogen substituents on the benzene ring as represented by formula (I) have unique color developing ability and oil resistance not seen in similar free organic carboxylic acids or their salts with other polyvalent metals. For example, such halogenated benzoic acids as 4-chlorobenzoic acid, 4-bromobenzoic acid or 4-iodobenzoic acid have no appreciable color-developing ability and are useless in practice as color developers for thermosensitive recording sheets.

Zinc salts of salicylic acid or its derivatives, such as zinc salicylate and zinc 5-(alpha-methylbenzyl)salicylate, have excellent color-forming ability and oil resistance, but are useless in practice because during the preparation of a thermosensitive coating composition, the coating composition undergoes coloration, and/or marked backgrounding occurs.

When zinc benzoates having 3 halogen atoms substituted on the benzene ring such as zinc trichlorobenzoate, metal salts of halogen-substituted benzoic acids other than the zinc salts, such as aluminum 4-chlorobenzoate, calcium 4-fluorobenzoate and magnesium 4-bromobenzoate, and known polyvalent metal salts of aromatic carboxylic acids such as zinc benzoate, zinc terephthalate, zinc p-hydroxybenzoate and zinc p-aminobenzoate are used as the color developers, thermosensitive recording sheets which are satisfactory in color density, oil resistance, image storage stability and background storage stability cannot be obtained.

In general formula (I) given hereinabove, the "alkyl group" may be linear or branched, and includes, for example, methyl, ethyl, n-propyl, isopropyl, n-butyl, sec-butyl, iso-butyl, tert-butyl, n-pentyl, hexyl, octyl. nonyl, and dodecyl. Generally, alkyl groups having 1 to 12 carbon atoms, above all lower alkyl groups, are preferred. The "alkoxy group" is an alkyl—O— group in which the alkyl moiety has the aforesaid meaning. Specific examples include methoxy, ethoxy, n-propoxy, isopropoxy, n-butoxy, tert-butoxy and octyloxy groups. Lower alkoxy groups are preferred.

The term "lower", as used in the present application, means that an atomic grouping or a compound qualified by this term has not more than 6, preferably not more than 4, carbon atoms.

The "cycloalkyl group" may have an alkyl group on the cycloaliphatic ring, and includes, for example, cyclopentyl, cyclohexyl, cycloheptyl, cyclooctyl, ethylcyclohexyl and tert-butylcyclohexyl groups. Preferred cycloalkyl groups generally have 3 to 10 carbon atoms, particularly 5 to 8 carbon atoms.

The "halogen atom" includes fluorine, chlorine, bromine and iodine atoms.

Typical examples of the zinc benzoates of general formula (I) are shown below. It should be understood however that they are merely illustrative, and the scope of the invention is not limited thereby. These halogen-substituted benzoic acid zinc salts can be produced, for example, by reacting the corresponding halogen-substituted benzoic acid sodium salts with zinc sulfate.

(1)

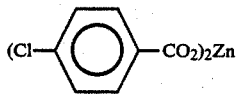

(2)

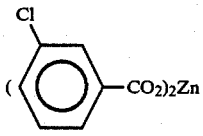

(3)

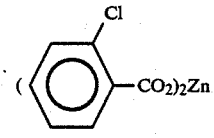

(4)

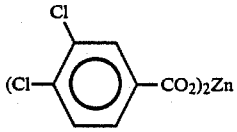

-continued (5)

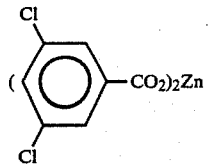

(6)

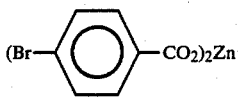

(7)

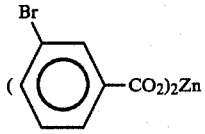

(8)

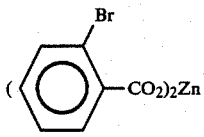

(9)

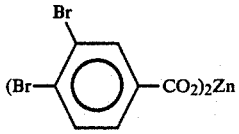

(10)

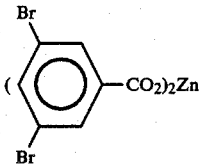

(11)

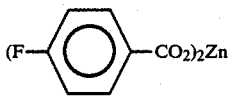

(12)

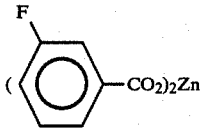

(13)

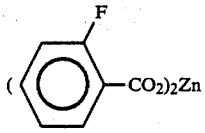

(14)

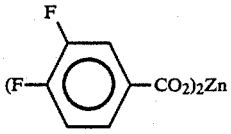

(15)

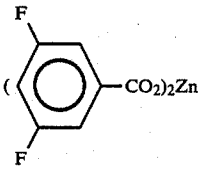

-continued (16)

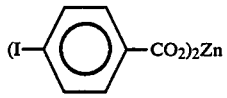

(17)

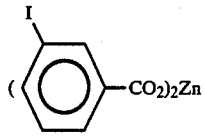

(18)

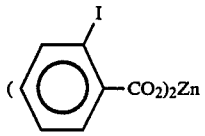

(19)

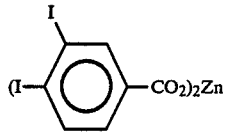

(20)

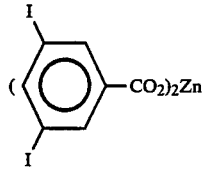

(21)

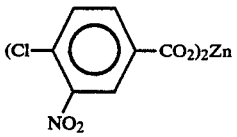

(22)

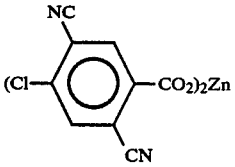

(23)

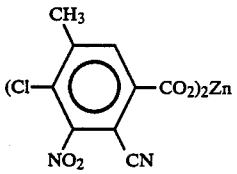

(24)

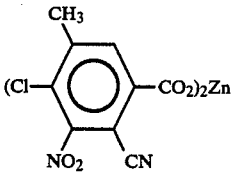

Of the above halogen-substituted benzoic acid zinc salts of general formula (I), those in which $R_1$, $R_2$ and $R_3$ are hydrogen atoms, for examples the compounds (1) to (20), are preferred.

As a color developer for a thermosensitive recording sheet, these halogen-substituted benzoic acid zinc salts may be used singly or in combination with each other or with another organic color developing agent.

Examples of the other organic color developers include bisphenols A, 4-hydroxybenzoate esters, 4-hydroxyphthalate diesters, phthalate monoesters, bis-(hydroxyphenyl)sulfides, 4-hydroxyphenyl arylsulfones, 4-hydroxyphenyl arylsulfonates, and 1,3-di[2-(hydroxyphenyl)-2-propyl]benzenes. Specific examples of these developers are shown below.

bisphenols A 4,4'-Isopropylidene diphenol (also known as bisphenol A),
4,4'-cyclohexylidene diphenyl, and
p,p'-(1-methyl-n-hexylidene)diphenol.

4-Hydroxybenzoate esters

Benzyl 4-hydroxybenzoate,
ethyl 4-hydroxybenzoate,
propyl 4-hydroxybenzoate,
isopropyl 4-hydroxybenzoate,
butyl 4-hydroxybenzoate,
isobutyl 4-hydroxybenzoate, and
methylbenzyl 4-hydroxybenzoate.

4-Hydroxyphthalate diesters

Dimethyl 4-hydroxyphthalate,
diisopropyl 4-hydroxyphthalate,
dibenzyl 4-hydroxyphthalate, and
dihexyl 4-hydroxyphthalate.

Phthalate monoesters

Monobenzyl phthalate,
monocyclohexyl phthalate,
monophenyl phthalate,
monomethylphenyl phthalate,
monoethylphenyl phthalate,
monoalkylbenzyl phthalates,
monohalobenzyl phthalates, and
monoalkoxybenzyl phthalates.

bis-(Hydroxyphenyl)sulfides bis-(4-Hydroxy-3-tert-butyl-6-methylphenyl)sulfide,
bis-(4-hydroxy-2,5-dimethylphenyl)sulfide,
bis-(4-hydroxy-2-methyl-5-ethylphenyl)sulfide,
bis-(4-hydroxy-2-methyl-5-isopropylphenyl)sulfide,
bis-(4-hydroxy-2,3-dimethylphenyl)sulfide,
bis-(4-hydroxy-2,5-diethylphenyl)-sulfide,
bis-(4-hydroxy-2,5-diisopropylphenyl)sulfide,
bis-(4-hydroxy-2,3,6-trimethylphenyl)sulfide,
bis-(2,4,5-trihydroxyphenyl)sulfide,
bis-(4-hydroxy-2-cyclohexyl-5-methylphenyl)sulfide,
bis-(2,3,4-trihydroxyphenyl)sulfide,
bis-(4,5-dihydroxy-2-tert-butylphenyl)sulfide,
bis-(4-hydroxy-2,5-diphenylphenyl)sulfide, and
bis-(4-hydroxy-2-tert-octyl-5-methylphenyl)sulfide.

4-Hydroxyphenyl arylsulfones

4-Hydroxy-4'-isopropoxydiphenylsulfone,
4-hydroxy-4'-methyldiphenylsulfone, and
4-hydroxy-4'-n-butyloxydiphenylsulfone.

4-Hydroxyphenyl arylsulfonates

4-Hydroxyphenyl benzenesulfonate,
4-hydroxyphenyl p-tolysulfonate,
4-hydroxyphenyl methylenesulfonate,
4-hydroxyphenyl p-chlorobenzenesulfonate,
4-hydroxyphenyl p-tert-butylbenzenedsulfonate,
4-hydroxyphenyl p-isopropoxybenzenesulfonae,
4-hydroxyphenyl 1'-naphthalenesulfonate, and 4-hydroxyphenyl 2'-naphthalenesulfonate.

1,3-di[2-(hydroxyphenyl)-2-propyl]benzenes 1,3-Di[2-(4-hydroxyphenyl)-2-propyl]benzene,
1,3-di[2-(4-hydroxy-3-alkylphenyl)-2-propyl]benzene,
1,3-di[2-(2,4-dihydroxyphenyl)-2-propyl]benzene, and
1,3-[2-(2-hydroxy-5-methylphenyl)-2-propyl]benzene.

Resorcinols 1,3-Dihydroxy-6(alpha,alpha-dimethylbenzyl)benzene.

Others p-tert-Butylphenol,
2,4-dihydroxybenzophenone,
novolak-type phenolic resins,
4-hydroxyacetophenone,
isobutyl-bis(4-hydroxyphenyl)acetate,
p-phenylphenol,
benzyl 4-hydroxypenylacetate, and
p-benzylphenol.

These color developers are used either singly or in combination. Preferred other organic developers that can be used together with the compound of formula (I) include, for example, 4,4'-isopropylidene diphenol, benzyl 4-hydroxybenzoate, 4-hydroxy-4'-isopropoxydiphenyl sulfone, and isobutyl-bis(4-hydroxyphenyl)acetate.

When the other color developer is used in combination with the compound of formula (I) as a color developer to be incorporated in the color developing layer of the thermosensitive recording sheet of this invention, the amount of the other developer is generally at most 80% by weight, preferably 5 to 60% by weight, based on the total weight of the color developers.

The "basic leuco dye" used in the thermosensitive recording sheet of this invention is a basic dye having the property of being normally colorless of light-colored but upon contact with the aforesaid color developers under heat, forming a color. There is no particular restriction on the basic leuco dye used in this invention and any basic leuco dyes heretofore used in thermosensitive recording sheets can equally be used. Generally, leuco dyes of the triphenylmethane, fluorane and azaphthalide types are preferred. Specific examples are shown below.

Triphenylmethane-type leuco dyes 3,3-bis(p-Dimethylaminophenyl)-6-dimethylaminophthalide (also called Crystal Violet Lactone).

Fluorane-type leuco dyes

3-Diethylamino-6-methyl-7-anilinofluorane,
3-(N-ethyl-p-toluidino)-6-methyl-7-anilinofluorane,
3-(N-ethyl-N-isoamyl)amino-6-methyl-7-anilinofluorane,
3-diethylamino-6-methyl-7-(o,p-dimethylanilino)fluorane,
3-pyrrolidino-6-methyl-7-anilinofluorane,
3-piperidino-6-methyl-7-anilinofluorane,
3-(N-cyclohexyl-N-methylamino)-6-methyl-7-anilinofluorane,
3-diethylamino-7-(m-trifluoromethylanilino)fluorane,
3-dibutylamino-7-(o-chloroanilino)fluorane,
3-diethylamino-6-methyl-chlorofluorane,
3-diethylamino-6-methyl-fluorane,
3-cyclohexylamino-6-chlorofluorane,
3-diethylamino-7-(o-chloroanilino)fluorane, and
3-diethylamino-benzo[a]-fluorane.

Azaphthalide-type leuco dyes 3-(4-Diethylamino-2-ethoxyphenyl-3-(1-ethyl-2-methylindol-3-yl)-4-azaphthalide,
3-(4-diethylamino-2-ethoxyphenyl)-3-(1-ethyl-2-methylindol-3-yl)-7-azaphthalide,
3-(4-diethylamino-2-ethoxyphenyl)-3-(1-octyl-2-methylindol-3-yl)-4-azaphthalide, and
3-(4-N-cyclohexyl-N-methylamino-2-methoxyphenyl)-3-(1-ethyl-2-methylindol-3-yl)-4-azaphthalide.

These dyes may also be used singly or in combination. In the present invention, a thermosensitive recording sheet having a markedly high dynamic image density can be obtained by using 3-diethylamino-6-methyl-7-anilinofluorane, 3-(N-cyclohexyl-N-methylamino)-6-methyl-7-anilinofluorane, 3-(N-ethyl-N-isoamyl)amino-6-methyl-7-anilinofluorane and 3-(4-diethylamino-2-ethoxyphenyl)-3-(1-ethyl-2-methylindol-3-yl)-4-azaphthalide singly as the basic leuco dye.

A thermosensitive recording sheet having excellent oil resistance and storage stability and a high dynamic image density can be obtained when a mixture of 3-diethylamino-6-methyl-7-anilinofluorane and 3-(N-cyclohexyl-N-methylamino)-6-methyl-7-anilinofluorane is used as the basic leuco dye.

According to this invention, a thermosensitive recording sheet which permits formation of colored images stable against the adhesion of hair-dressing agents or oils and fats and has excellent optical readability in the visible and infrared regions can be provided by using a combination of a fluorene-type leuco dye and a black color forming fluorane-leuco dye as the basic leuco dye.

Two-component thermosensitive recording sheets are generally used for thermosensitive recording. In particular, color former-type two-component thermosensitive recording sheets are in most widespread use. This type of thermosensitive recording sheet has a color-forming layer composed of a basic leuco dye as an electron donor and an organic acidic substance such as phenolic compounds, aromatic carboxylic acids or organic sulfonic acids as an electron acceptor. The heat fusion reaction between the basic leuco dye and the color developer is an acid-base reaction based on the donation and acceptance of electrons whereby a pseudo-stable "electron transfer complex" is formed to give a colored image.

These thermosensitive recording sheets are also utilized as thermosensitive labels. Since, however, color formation in these recording sheets is in the visible region, they cannot be adapted for reading by a semiconductor laser in the near infrared region which is in widespread use as a bar code scanner in a POS system, etc.

Japanese Laid-Open Patent Publication No. 199757/1984 discloses a thermosensitive recording sheet containing a fluorene-type leuco dye having excellent color formability in the near infrared region. However, an image recorded thereon on the basis of an acid-base reaction between the leuco dye and a conventional color developer such as acid clay, a phenolic resin, hydroxybenzoic acid or bisphenol A has an insufficient absorption in the near infrared region for reading, and also has inferior color formability in the visible region. In addition, the recorded image lacks stability and has the defect that by the unavoidable adhesion of oils and fats or with time, the recorded color disappears in the visible region, and the ability of the recorded image to absorb infrared rays in the near infrared region is drastically reduced.

The above defect can be remedied in accordance with this invention by using the halogen-substituted benzoic acid zinc salt of general formula (I) as a color developer and a combination of a fluorene-type leuco dye of a color with a color forming pattern having the property of absorbing light in the infrared region and therefore having excellent optical readability in the near infrared region and a black-forming fluorane-type leuco dye capable of inducing formation of a visible color in the visible region as a leuco dye and thus preparing a thermosensitive recording sheet which can permit reading both in the visible region and in the near infrared region.

Fluorene-type leuco dyes used for this purpose are those of general formula (II) below, and specific examples are tabulated below.

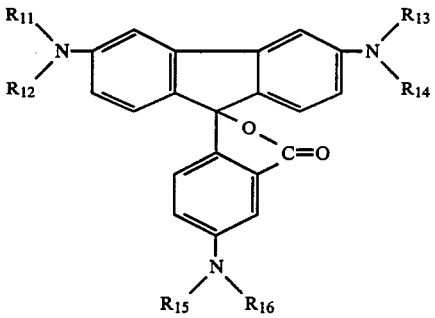

(II)

wherein $R_{11}$, $R_{12}$, $R_{13}$, $R_{14}$, $R_{15}$ and $R_{16}$, independently from each other, represent a lower alkyl group.

| No. | $R_1$ | $R_2$ | $R_3$ | $R_4$ | $R_5$ | $R_6$ |
|---|---|---|---|---|---|---|
| 1 | $-CH_3$ | $-CH_3$ | $-CH_3$ | $-CH_3$ | $-CH_3$ | $-CH_3$ |
| 2 | $-C_2H_5$ | $-C_2H_5$ | $-CH_3$ | $-CH_3$ | $-CH_3$ | $-CH_3$ |
| 3 | $-C_2H_5$ | $-C_2H_5$ | $-C_2H_5$ | $-C_2H_5$ | $-CH_3$ | $-CH_3$ |
| 4 | $-C_4H_9$ | $-C_4H_9$ | $-CH_3$ | $-CH_3$ | $-CH_3$ | $-CH_3$ |
| 5 | $-C_4H_9$ | $-C_4H_9$ | $-C_2H_5$ | $-C_2H_5$ | $-CH_3$ | $-CH_3$ |
| 6 | $-CH_3$ | $-CH_3$ | $-CH_3$ | $-CH_3$ | $-C_2H_5$ | $-C_2H_5$ |
| 7 | $-C_2H_5$ | $-C_2H_5$ | $-CH_3$ | $-CH_3$ | $-C_2H_5$ | $-C_2H_5$ |
| 8 | $-C_4H_9$ | $-C_4H_9$ | $-CH_3$ | $-CH_3$ | $-C_2H_5$ | $-C_2H_5$ |
| 9 | $-C_2H_5$ | $-C_2H_5$ | $-C_2H_5$ | $-C_2H_5$ | $-C_2H_5$ | $-C_2H_5$ |
| 10 | $-C_4H_9$ | $-C_4H_9$ | $-C_2H_5$ | $-C_2H_5$ | $-C_2H_5$ | $-C_2H_5$ |
| 11 | $-CH_3$ | $-CH_3$ | $-CH_3$ | $-CH_3$ | $-C_4H_9$ | $-C_4H_9$ |
| 12 | $-C_2H_5$ | $-C_2H_5$ | $-CH_3$ | $-CH_3$ | $-C_4H_9$ | $-C_4H_9$ |

Examples of especially preferred fluorene-type leuco dyes include 3,6,6'-tris(dimethylamino)spiro[fluorene-9,3'-phthalide] and 3,6,6'-tris(diethylamino)spiro[fluorene-9,3'-phthalide].

There is no particular limitation on the black-forming fluorane-type leuco dyes used in combination with the fluorene-type leuco dyes. Examples of preferred species are 3-diethylamino-6-methyl-7-anilinofluorane,
3-(N-ethyl-p-toluidino)-6-methyl-7-anilinofluorane,
3-(N-ethyl-N-isoamyl)amino-6-methyl-7-anilinofluorane,
3-diethylamino-6-methyl-7-(o,p-dimethylanilino)fluorane,
3-pyrrolidino-6-methyl-7-anilinofluorane,
3-piperidino-6-methyl-7-anilinofluorane,
3-(N-cyclohexyl-N-methylamino)-6-methyl-7-anilinofluorane,
3-diethylamino-7-(m-trifluoromethylanilino)fluorane,
3-dibutylamino-7-(o-chloroanilino)fluorane, and
3-diethylamino-7-(o-chloroanilino)fluorane.

Preferred among these are 3-diethylamino-7-(o-chloroanilino)fluorane, 3-dibutylamino-7-(o-chloroanilino)fluorane, and 3-diethylamino-6-methylanilinofluorane.

The weight ratio of the fluorene-type leuco dye to the black-forming fluorane-type leuco dye is generally from 30:70 to 90:10, preferably from 50:50 to 80:20.

The proportion of the color developer containing the compound of formula (I) can be varied widely according to the types of the dye and the color developer, for example. Generally, it is conveniently used in a proportion of 1 to 5 parts by weight, preferably 2 to 4 parts by weight, per part by weight of the dye.

As required, the thermosensitive color-forming layer of the thermosensitive recording sheet of this invention may contain a sensitizer such as dibenzyl terephthalate, benzyl p-benzyloxybenzoate, di-p-tolyl carbonate, p-benzyl biphenyl and phenyl alpha-naphthylcarbonate. It has been found that when a naphthyl ether represented by the following general formula (III) or (IV)

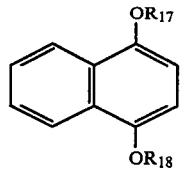

(III)

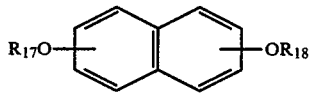

(IV)

wherein $R_{17}$ and $R_{18}$, independently from each other, represent an alkyl group, preferably a lower alkyl group, a cycloalkyl group, particularly a cyclohexyl group, a phenyl group or a benzyl group, is used as the sensitizer in this invention, the thermal color forming sensitivity of the thermosensitive color forming layer can be increased.

Specific examples of the naphthyl ether of formula (III) include 1,4-dimethoxynaphthalene,
1,4-diethoxynaphthalene,
1,4-dipropoxynaphthalene,
1,4-dibutoxynaphthalene,
1,4-dibenzyloxynaphthalene,
1-methoxy-4-ethoxynaphthalene,
1-methoxy-4-propoxynaphthalene,
1-methoxy-4-butoxynaphthalene,
1-methoxy-4-benzyloxynaphthalene,
1-ethoxy-4-propoxynaphthalene,
1-ethoxy-4-butoxynaphthalene,
1-ethoxy-4-benzyloxynaphthalene,
1-propoxy-4-butoxynaphthalene,
1-propoxy-4-benzyloxynaphthalene, and
1-butoxy-4-benzyloxynaphthalene.

Specific examples of the naphthyl ethers of formula (IV) include 2,7-diethoxynaphthalene,
2,7-dibenzyloxynaphthalene,
2,7-diisoamyloxynaphthalene,
1,5-diisopropoxynaphthalene,
1,5-dibutoxynaphthalene,
1,5-dicycliohexoxynaphthalene, 1,7-diisopropoxynaphthalene,
1,7-dibutoxynaphthalene,
1,7-dibenzyloxynaphthalene,
1-butoxy-5-benzyloxynaphthalene,
2-benzyloxy-6-1-butoxynaphthalene, and
2-benzyloxy-6-phenoxynaphthalene.

Especially preferred among the naphthyl ethers of formulae (III) and (IV) are 1,4-diethoxynaphthalene, 1-ethoxy-4-benzyloxynaphthalene, and 1-methoxy-4-ethoxynaphthalene.

The proportion of the sensitizer used is not critical, and can be varied over a broad range depending upon the type of the sensitizer, the type of the dye, etc. Generally, it is 2 to 6 parts by weight, preferably 3 to 5 parts by weight, per part by weight of the dye.

The color developer and the basic leuco dye and optionally, the sensitizer are reduced to fine particles having a particle diameter of less than several microns by a grinding machine such as a ball mill, an attriter or a sand grinder, or a suitable emulsifying device, and according to the purpose for which the final product is used, various additives are added. The resulting coating composition is coated on a substrate such as paper or a plastic film, and dried to form a thermosensitive recording layer whose amount of coating is 4 to 10 g/m$^2$ (in a dry condition). As a result, the thermosensitive recording sheet of this invention can be obtained.

The other additives which can be blended with the color developer, the basic leuco dye and the sensitizer may be those which are used in conventional thermosensitive recording sheets. Examples include binders such as polyvinyl alcohol, modified polyvinyl alcohol, hydroxyethyl cellulose, methyl cellulose, starches, a styrene/maleic anhydride copolymer, a vinyl acetate/maleic anhydride copolymer and a styrene/butadiene copolymer; inorganic or organic fillers such as kaolin, calcined kaolin, diatomaceous earth, talc, titanium oxide and aluminum hydroxide; mold releasing agents such as fatty acid metal salts; lubricants such as waxes; ultraviolet absorbers such as benzophenone compounds and triazole compounds; waterproofing agents such as glyoxal; dispersing agents such as sodium hexametaphosphate and sodium polycarboxylates; defoamers such as acetylene glycol; pressure for preventing agents such as fatty acid amides, ethylenebisamide, montan wax and polyethylene wax; and stabilizers such as phthalic acid monoester metal salts, p-tertiary butylbenzoic acid metal salts and nitrobenzoic acid metal salts. The amounts of these additives are determined depending upon the properties required of the product, its recording suitability, etc., and are not particulary restricted. As tentative standards, they are, for example, 10 to 20% by weight based on the total solids for the binders, and 1 to 20 parts by weight per part by weight of the leuco dye for the fillers. The other components may be used in amounts normally used.

The characteristics and advantages of the thermosensitive recording sheet of this invention are as follows:

(1) It has resistance to the adhesion of soiling substances such as hair-dressing agents and oils and fats, and therefore gives images of good stability (good soiling resistance).
(2) The background is stable even under high-temperature and high humidity conditions, and there is little backgrounding with time.
(3) Because of its excellent thermal response, it can give a clear high-density image in high-speed and high-density recording.
(4) Images recorded thereon have excellent storage stability over an extended period of time, and particularly do not fade under the effect of moisture, heat, etc.
(5) The combined use of the fluorene-type leuco dye and the fluorane-type leuco dye give excellent optical readability in the visible and near infrared regions, under moisture and heat, and do not undergo backgrounding.

The following Examples and Comparative Examples illustrate the present invention more specifically. All parts in these examples are by weight.

EXAMPLE 1

| | |
|---|---|
| Dispersion A (dye dispersion) | |
| 3-Diethylamino-6-methyl-7-anilino fluorane | 2.0 parts |
| 10% aqueous polyvinyl alcohol solution | 4.6 parts |
| Water | 2.5 parts |
| Dispersion B (developer dispersion) | |
| Color developer (see Table 1) | 6 parts |
| 10% Aqueous polyvinyl alcohol solution | 18.8 parts |
| Water | 11.2 parts |

In each run, the dispersions of the above compositions were ground to a particle diameter of 3 microns by an attriter. The following dispersions were then mixed in the proportions and indicated below to form a coating dispersion.

| | |
|---|---|
| Dispersion A | 9.1 parts |
| Dispersion B | 36 parts |
| Kaolin clay (50% dispersion) | 12 parts |

The coating dispersion was coated on one surface of a substrate paper (basis weight 50 g/m$^2$) at a rate of 6.0 g/m$^2$, and dried. The sheet was treated by a supercalender so that its degree of smoothness became 200 to 300 seconds. The resulting thermosensitive recording sheet adapted to develop a black color was tested for properties. The results are shown in Table 1.

COMPARATIVE EXAMPLE 1

| Dispersion C (color developer dispersion) | |
|---|---|
| Color developer (see Table 1) | 6 parts |
| 10% Aqueous polyvinyl alcohol solution | 18.8 parts |
| Water | 11.2 parts |

A thermosensitive recording sheet was prepared in the same way as in Example 1 except that dispersion C was used instead of dispersion B. The results of testing the recording sheet are shown in Table 1.

COMPARATIVE EXAMPLE 2

| Dispersion D (color developer dispersion) | |
|---|---|
| Color developer (see Table 1) | 6 parts |
| 10% Aqueous polyvinyl alcohol solution | 18.8 parts |
| Water | 11.2 parts |

A thermosensitive recording sheet was prepared in the same way as in Example 1 except that dispersion D was used instead of dispersion B. The results of testing the recording sheet are shown in Table 1.

COMPARATIVE EXAMPLE 3

| Dispersion E (color developer dispersion) | |
|---|---|
| Color developer (see Table 1) | 6 parts |
| 10% Aqueous polyvinyl alcohol solution | 18.8 parts |
| Water | 11.2 parts |

A thermosensitive recording sheet was prepared in the same way as in Example 1 except that dispersion E was used instead of dispersion B. The results of testing the recording sheet are shown in Table 1.

COMPARATIVE EXAMPLE 4

| Dispersion F (color developer dispersion) | |
|---|---|
| Color developer (see Table 1) | 6 parts |
| 10% Aqueous polyvinyl alcohol solution | 18.8 parts |
| Water | 11.2 parts |

A thermosensitive recording sheet was prepared in the same way as in Example 1 except that dispersion F was used instead of dispersion B. The results of testing the recording sheet are shown in Table 1.

EXAMPLE 2

| | |
|---|---|
| Dispersion G (dye dispersion) | |
| Crystal violet lactone | 2.0 parts |
| 10% Aqueous polyvinyl alcohol solution | 4.6 parts |
| Water | 2.5 parts |
| Dispersion B (color developer dispersion) | |
| Color developer (see Table 2) | 6 parts |
| 10% Aqueous polyvinyl alcohol solution | 18.8 parts |
| Water | 11.2 parts |

In each run, the dispersions of the above compositions were ground to a particle diameter of 3 micron by an atriter. Then, the following dispersions were mixed in the proportion indicated below to form a coating dispersion.

| | |
|---|---|
| Dispersion G (dye dispersion) | 9.1 parts |
| Dispersion B (color developer dispersion) | 36 parts |
| Kaolin clay (50% dispersion) | 12 parts |

The coating dispersion was coated on one surface of a substrate paper (basis weight 50 g/m$^2$) at a rate of 6.0 g/m$^2$, and dried. The sheet was treated by a supercalender so that its degree of smoothness became 200 to 300 seconds. The resulting thermosensitive recording sheet adapted to develop a black color was tested for properties. The results are shown in Table 2.

COMPARATIVE EXAMPLE 5

| Dispersion C (color developer dispersion) | |
|---|---|
| Color developer (see Table 2) | 6 parts |
| 10% Aqueous polyvinyl alcohol solution | 18.8 parts |
| Water | 11.2 parts |

A thermosensitive recording sheet was prepared in the same way as in Example 2 except that dispersion C was used instead of dispersion B. The results of testing the recording sheet are shown in Table 2.

COMPARATIVE EXAMPLE 6

| Dispersion D (color developer dispersion) | |
|---|---|
| Color developer (see Table 2) | 6 parts |
| 10% Aqueous polyvinyl alcohol solution | 18.8 parts |
| Water | 11.2 parts |

A thermosensitive recording sheet was prepared in the same way as in Example 2 except that dispersion D was used instead of dispersion B. The results of testing the recording sheet are shown in Table 2.

COMPARATIVE EXAMPLE 7

| Dispersion E (color developer dispersion) | |
|---|---|
| Color developer (see Table 2) | 6 parts |
| 10% Aqueous polyvinyl alcohol solution | 18.8 parts |
| Water | 11.2 parts |

A thermosensitive recording sheet was prepared in the same way as in Example 2 except that dispersion E was used instead of dispersion B. The results of testing the recording sheet are shown in Table 2.

COMPARATIVE EXAMPLE 8

| Dispersion F (color developer dispersion) | |
|---|---|
| Color developer (see Table 2) | 6 parts |
| 10% Aqueous polyvinyl alcohol solution | 18.8 parts |
| Water | 11.2 parts |

A thermosensitive recording sheet was prepared in the same way as in Example 2 except that dispersion F was used instead of dispersion B. The results of testing the recording sheet are shown in Table 2.

TABLE 1

| | Test No. | Color Developer | Image density (*1) Static (*2) | Image density (*1) Dynamic (*3) | Oil resistance (*4) Untreated | Oil resistance (*4) Treated | Oil resistance (*4) Percent Residue (%) | Stability of the recorded image (*5) Untreated | Stability of the recorded image (*5) Moisture Resistance (*6) | Stability of the recorded image (*5) Heat Resistance (*7) | Stability of the background (*8) Untreated | Stability of the background (*8) Moisture Resistance (*6) | Stability of the background (*8) Heat Resistance (*7) |
|---|---|---|---|---|---|---|---|---|---|---|---|---|---|
| Ex. 1 | 1 | Zinc p-fluorobenzoate | 0.65 | 0.70 | 0.70 | 0.70 | 100.0 | 0.70 | 0.46 | 0.80 | 0.04 | 0.04 | 0.09 |
| | 2 | Zinc p-chlorobenzoate | 0.63 | 0.64 | 0.64 | 0.67 | 104.7 | 0.64 | 0.41 | 0.77 | 0.04 | 0.05 | 0.09 |
| | 3 | Zinc p-bromobenzoate | 0.62 | 0.60 | 0.60 | 0.67 | 111.6 | 0.60 | 0.52 | 0.62 | 0.04 | 0.05 | 0.10 |
| | 4 | Zinc m-chlorobenzoate | 0.67 | 0.67 | 0.67 | 0.78 | 116.4 | 0.67 | 0.56 | 0.70 | 0.04 | 0.08 | 0.09 |
| | 5 | Zinc p-iodobenzoate | 0.62 | 0.63 | 0.63 | 0.71 | 112.6 | 0.63 | 0.47 | 0.65 | 0.04 | 0.05 | 0.10 |
| | 6 | Zinc 3,4-dichlorobenzoate | 0.64 | 0.68 | 0.68 | 0.71 | 104.4 | 0.68 | 0.49 | 0.70 | 0.04 | 0.04 | 0.10 |
| CEx. 1 | 7 | p-Chlorobenzoic acid | 0.06 | 0.06 | — | — | — | 0.06 | 0.06 | 0.06 | 0.06 | 0.06 | 0.06 |
| | 8 | p-Bromobenzoic acid | 0.05 | 0.06 | — | — | — | 0.06 | 0.06 | 0.06 | 0.06 | 0.06 | 0.06 |
| | 9 | p-Iodobenzoic acid | 0.05 | 0.06 | — | — | — | 0.06 | 0.06 | 0.06 | 0.06 | 0.06 | 0.06 |

TABLE 1-continued

| | Test No. | Color Developer | Image density (*1) Static (*2) | Image density (*1) Dynamic (*3) | Oil resistance (*4) Untreated | Oil resistance (*4) Treated | Oil resistance (*4) Percent Residue (%) | Stability of the recorded image (*5) Untreated | Stability of the recorded image (*5) Moisture Resistance (*6) | Stability of the recorded image (*5) Heat Resistance (*7) | Stability of the background (*8) Untreated | Stability of the background (*8) Moisture Resistance (*6) | Stability of the background (*8) Heat Resistance (*7) |
|---|---|---|---|---|---|---|---|---|---|---|---|---|---|
| CEx. | 10 | Bisphenol A | 1.06 | 0.85 | 0.85 | 0.51 | 60.0 | 0.85 | 0.81 | 0.79 | 0.07 | 0.13 | 0.13 |
| 2 | 11 | Benzyl 4-hydroxybenzoate | 1.40 | 1.28 | 1.28 | 0.43 | 34.0 | 1.28 | 1.20 | 1.23 | 0.04 | 0.06 | 0.14 |
| CEx. | 12 | Zinc benzoate | 0.29 | 0.64 | 0.64 | 0.55 | 85.9 | 0.64 | 0.54 | 0.60 | 0.06 | 0.08 | 0.10 |
| 3 | 13 | Zinc trichlorobenzoate | 0.27 | 0.73 | 0.73 | 0.52 | 71.2 | 0.73 | 0.65 | 0.70 | 0.06 | 0.08 | 0.12 |
| CEx. | 14 | Zinc terephthalate | 0.25 | 0.40 | 0.40 | 0.30 | 75.0 | 0.40 | 0.32 | 0.38 | 0.07 | 0.08 | 0.13 |
| 3 | 15 | Zinc p-hydroxybenzoate | 0.28 | 0.41 | 0.41 | 0.32 | 78.0 | 0.41 | 0.33 | 0.40 | 0.07 | 0.08 | 0.12 |
| | 16 | Zinc p-aminobenzoate | 0.21 | 0.30 | 0.30 | 0.24 | 80.0 | 0.30 | 0.22 | 0.29 | 0.06 | 0.08 | 0.14 |
| | 17 | Zinc salicylate | 0.40 | 0.64 | 0.64 | 0.57 | 89.1 | 0.64 | 0.56 | 0.65 | 0.14 | 0.23 | 0.25 |
| | 18 | Zinc 5-(alpha-methylbenzyl) salicylate | 0.37 | 0.60 | 0.60 | 0.55 | 91.7 | 0.60 | 0.52 | 0.62 | 0.12 | 0.21 | 0.25 |
| CEx. | 19 | Aluminum p-chlorobenzoate | 0.20 | 0.30 | 0.30 | 0.23 | 76.6 | 0.30 | 0.15 | 0.50 | 0.04 | 0.05 | 0.10 |
| 4 | 20 | Calcium p-fluorobenzoate | 0.32 | 0.41 | 0.41 | 0.32 | 78.0 | 0.41 | 0.26 | 0.62 | 0.04 | 0.05 | 0.12 |
| | 21 | Magnesium p-bromobenzoate | 0.20 | 0.31 | 0.31 | 0.25 | 80.6 | 0.31 | 0.16 | 0.51 | 0.04 | 0.05 | 0.10 |
| | 22 | Nickel m-chlorobenzoate | 0.30 | 0.40 | 0.40 | 0.32 | 80.0 | 0.40 | 0.25 | 0.60 | 0.04 | 0.05 | 0.12 |
| | 23 | Manganese p-iodobenzoate | 0.25 | 0.35 | 0.35 | 0.28 | 80.0 | 0.35 | 0.20 | 0.55 | 0.04 | 0.50 | 0.11 |
| | 24 | Tin 3,4-dichlorobenzoate | 0.30 | 0.40 | 0.40 | 0.31 | 77.5 | 0.40 | 0.25 | 0.60 | 0.04 | 0.05 | 0.13 |

Ex. = Example; CEx. = Comparative Example; "—" shows that the test was not conducted because the color formation was insufficient.

TABLE 2

| | Test No. | Color developer | Image density (*1) Static (*2) | Image density (*1) Dynamic (*3) | Oil resistance (*4) Untreated | Oil resistance (*4) Treated | Oil resistance (*4) Percent residue (%) |
|---|---|---|---|---|---|---|---|
| Ex. 2 | 25 | Zinc p-fluorobenzoate | 1.11 | 1.17 | 1.17 | 0.94 | 80.3 |
| | 26 | Zinc p-chlorobenzoate | 0.97 | 0.70 | 0.70 | 0.69 | 98.6 |
| | 27 | Zinc p-bromobenzoate | 0.89 | 0.82 | 0.82 | 0.69 | 84.1 |
| | 28 | Zinc m-chlorobenzoate | 1.15 | 0.94 | 0.94 | 0.80 | 85.1 |
| | 29 | Zinc p-iodobenzoate | 1.10 | 1.01 | 1.01 | 0.80 | 79.2 |
| | 30 | Zinc 3,4-dichlorobenzaote | 1.12 | 1.11 | 1.11 | 0.88 | 79.3 |
| CEx. 5 | 31 | p-Chlorobenzoic acid | 0.04 | 0.04 | — | — | — |
| | 32 | p-Bromobenzoic acid | 0.04 | 0.04 | — | — | — |
| | 33 | p-Iodobenzoic acid | 0.04 | 0.04 | — | — | — |
| CEx. 6 | 34 | Bisphenol A | 1.02 | 0.85 | 0.85 | 0.09 | 10.6 |
| CEx. 7 | 35 | Zinc benzoate | 0.30 | 0.58 | 0.58 | 0.25 | 43.1 |
| | 36 | Zinc trichlorobenzoate | 0.31 | 0.50 | 0.50 | 0.21 | 42.0 |
| | 37 | Zinc terephthalate | 0.29 | 0.37 | 0.37 | 0.16 | 43.2 |
| | 38 | Zinc p-hydrobenzoate | 0.32 | 0.35 | 0.35 | 0.16 | 45.7 |
| | 39 | Zinc p-aminobenzoate | 0.31 | 0.37 | 0.37 | 0.17 | 45.9 |
| | 40 | Zinc salicylate | 0.81 | 0.99 | 0.99 | 0.83 | 83.8 |
| | 41 | Zinc 5-(alpha-methylbenzyl)salicylate | 0.80 | 0.90 | 0.90 | 0.73 | 81.1 |
| CEx. 8 | 42 | Aluminum p-chlorobenzoate | 0.19 | 0.34 | 0.34 | 0.08 | 26.7 |
| | 43 | Calcium p-fluorobenzoate | 0.48 | 0.40 | 0.40 | 0.12 | 30.0 |
| | 44 | Magnesium p-bromobenzoate | 0.41 | 0.32 | 0.32 | 0.10 | 31.3 |
| | 45 | Nickel m-chlorobenzoate | 0.37 | 0.35 | 0.35 | 0.12 | 34.3 |
| | 46 | Manganese p-iodobenzoate | 0.38 | 0.31 | 0.31 | 0.10 | 32.3 |
| | 47 | Tin 3,4-dichlorobenzoate | 0.40 | 0.33 | 0.33 | 0.11 | 33.3 |

| | Test No. | Stability of the recorded image (*5) Untreated | Stability of the recorded image (*5) Moisture resistance (*6) | Stability of the recorded image (*5) Heat resistance (*7) | Stability of the background (*8) Untreated | Stability of the background (*8) Moisture resistance (*6) | Stability of the background (*8) Heat resistance (*7) |
|---|---|---|---|---|---|---|---|
| Ex. 2 | 25 | 1.17 | 0.88 | 1.20 | 0.05 | 0.06 | 0.10 |
| | 26 | 0.70 | 0.65 | 0.72 | 0.04 | 0.05 | 0.09 |
| | 27 | 0.82 | 0.75 | 0.85 | 0.05 | 0.06 | 0.11 |
| | 28 | 0.94 | 0.80 | 1.05 | 0.04 | 0.06 | 0.09 |
| | 29 | 1.01 | 0.86 | 1.20 | 0.04 | 0.05 | 0.09 |
| | 30 | 1.11 | 0.85 | 1.20 | 0.04 | 0.05 | 0.10 |
| CEx. 5 | 31 | 0.04 | 0.04 | 0.04 | 0.04 | 0.04 | 0.04 |
| | 32 | 0.04 | 0.04 | 0.04 | 0.04 | 0.04 | 0.04 |
| | 33 | 0.04 | 0.04 | 0.04 | 0.04 | 0.04 | 0.04 |
| CEx. 6 | 34 | 0.85 | 0.70 | 0.63 | 0.05 | 0.05 | 0.06 |
| CEx. 7 | 35 | 0.58 | 0.29 | 0.48 | 0.06 | 0.06 | 0.12 |
| | 36 | 0.50 | 0.25 | 0.40 | 0.06 | 0.06 | 0.12 |
| | 37 | 0.37 | 0.20 | 0.27 | 0.06 | 0.06 | 0.10 |
| | 38 | 0.35 | 0.22 | 0.25 | 0.07 | 0.07 | 0.13 |
| | 39 | 0.37 | 0.22 | 0.27 | 0.06 | 0.06 | 0.14 |
| | 40 | 0.99 | 0.83 | 1.04 | 0.12 | 0.19 | 0.19 |
| | 41 | 0.90 | 0.85 | 0.95 | 0.15 | 0.25 | 0.25 |
| CEx. 8 | 42 | 0.34 | 0.11 | 0.14 | 0.04 | 0.07 | 0.05 |
| | 43 | 0.40 | 0.21 | 0.67 | 0.04 | 0.06 | 0.06 |
| | 44 | 0.32 | 0.12 | 0.20 | 0.04 | 0.07 | 0.06 |
| | 45 | 0.35 | 0.15 | 0.24 | 0.04 | 0.07 | 0.07 |

TABLE 2-continued

| | | | | | | |
|---|---|---|---|---|---|---|
| 46 | 0.31 | 0.17 | 0.22 | 0.04 | 0.06 | 0.06 |
| 47 | 0.33 | 0.20 | 0.65 | 0.04 | 0.06 | 0.05 |

Ex., CEx. and "—" have the same meaning as indicated in the footnote to Table 1.

Notes to Table 1 and 2

(*1) Image density

Measured by a Macbeth densitometer (RD-514 with an amber filter; the Macbeth densitometers mentioned hereinafter are the same as this one)

(*2) Static image density

The recording sheet was pressed against a hot plate heated at 105° C. by applying a pressure of 10 g/cm$^2$ for 5 seconds, and the density of the formed color was measured by the Macbeth densitometer.

(*3) Dynamic image density

The density of an image recorded on the thermosentitive recording sheet by a thermosensitive facsimile (KB-4800 made by Tokyo Shibaura Electric Co., Ltd.) with an applied voltage of 18.03 V and a pulse width of 3.2 milliseconds was measured by the Macbeth densitometer.

(*4) Oil resistance

The density of an image recorded on the thermosentitive recording sheet by a thermosensitive facsimile (KB-4800 made by Tokyo Shibaura Electric Co., Ltd.) with an applied voltage of 18.03 V and pulse wodth of 3.2 milliseconds was measured by the Macbeth densitometer. This density is termed the density of the untreated image. Castor oil was applied dropwise to the printed colored part, and 10 seconds later, lightly wiped off with filter paper. After standing for 3 days at room temperature, the density of the colored image was measured by the Macbeth densitometer, and the percent residue was calculated in accordance with the following equation.

$$\text{Percent residue} = \frac{\text{Density of the image treated with the oil}}{\text{Density of the untreated image}} \times 100$$

(*5) Stability of the recorded image

Measured in accordance with the method (3).

(*6) Moisture resistance

The thermosensitive recording sheet was left to stand for 24 hours at 40° C. and 90% RH, and the optical density of its background was measured.

(*7) Heat resistance

The thermosensitive recording sheet was left to stand for 24 hours under drying conditions at 60° C., and the optical density of its background was measured.

(*8) Stability of the background

The optical density of an uncolored portion of the thermosensitive recording sheet was measured by the Macbeth densitometer.

EXAMPLE 3

| | |
|---|---|
| Dispersion G (dye dispersion) | |
| 3-Diethylamino-6-methyl-7-anilino fluorane | 2.0 parts |
| 10% Aqueous polyvinyl alcohol solution | 4.6 parts |
| Water | 2.5 parts |
| Dispersion H (color developer dispersion) | |
| Zinc p-chlorobenzoate | 6.0 parts |
| 10% Aqueous polyvinyl alcohol solution | 29.5 parts |
| Water | 5.5 parts |
| Dispersion I (sensitizer dispersion) | |
| 1,4-Diethoxynaphthalene | 4.0 parts |
| 10% Aqueous polyvinyl alcohol solution | 5.0 parts |
| Water | 3.0 parts |

The dispersions of the above compositions were ground to a particle diameter of 3 microns by an attriter.

The following dispersions were mixed in the proportions indicated to form a coating dispersion.

| | |
|---|---|
| Dispersion G (dye dispersion) | 9.1 parts |
| Dispersion H (color developer dispersion) | 41.0 parts |
| Dispersion I (sensitizer dispersion) | 12.0 parts |
| Kaolin clay (50% dispersion) | 20.0 parts |

The coating dispersion was coated on one surface of a substrate paper (basis weight 50 g/m$^2$) at a rate of 6.0 g/m$^2$, and dried. The sheet was treated by a supercalender so that its degree of smoothness became 200 to 600 seconds. A thermosensitive recording sheet was obtained.

EXAMPLE 4

| | |
|---|---|
| Dispersion J (color developer dispersion) | |
| Zinc m-chlorobenzoate | 6.0 parts |
| 10% Aqueous polyvinyl alcohol solution | 29.5 parts |

-continued

| | |
|---|---|
| Dispersion J (color developer dispersion) | |
| Water | 5.5 parts |

A thermosensitive recording sheet was prepared in the same way as in Example 3 except that dispersion J was used instead of dispersion H.

COMPARATIVE EXAMPLE 9

A thermosensitive recording sheet was prepared in the same way as in Example 3 except that dispersion I was not used.

COMPARATIVE EXAMPLE 10

A thermosensitive recording sheet was prepared in the same way as in Example 4 except that dispersion I was not used.

COMPARATIVE EXAMPLE 11

| | |
|---|---|
| Dispersion K (sensitizer dispersion) | |
| Benzyl p-benzyloxybenzoate | 4.0 parts |
| 10% Aqueous polyvinyl alcohol | 5.0 parts |
| Water | 3.0 parts |

A thermosensitive recording sheet was prepared in the same way as in Example 3 except that dispersion K was used instead of dispersion I.

COMPARATIVE EXAMPLE 12

A thermosensitive recording sheet was prepared in the same way as in Example 4 except that dispersion K of Comparative Example 11 was used instead of dispersion I.

COMPARATIVE EXAMPLE 13

| | |
|---|---|
| Dispersion L (color developer dispersion) | |
| bisphenol A | 6.0 parts |
| 10% Aqueous polyvinyl alcohol solution | 29.5 parts |

-continued

| Dispersion L (color developer dispersion) | |
|---|---|
| Water | 5.5 parts |

A thermosensitive recording sheet was prepared in the same way as in Example 3 except that dispersion L treated by an attriter was used instead of dispersion H.

COMPARATIVE EXAMPLE 14

A thermosensitive recording sheet was prepared in the same way as in Comparative Example 13 except that dispersion I used in Comparative Example 13 was not used.

COMPARATIVE EXAMPLE 15

| Dispersion M (color developer dispersion) | |
|---|---|
| 3,5-Di-t-butylsalicylic acid | 6.0 parts |
| 10% Aqueous polyvinyl alcohol solution | 29.5 parts |
| Water | 5.5 parts |

A thermosensitive recording sheet was prepared in the same way as in Example 3 except that dispersion M treated by an attriter was used instead of dispersion H.

COMPARATIVE EXAMPLE 16

A thermosensitive recording sheet was prepared in the same way as in Comparative Example 15 except that dispersion I was not used.

The thermosensitive recording sheets obtained in Examples 3 and 4 and Comparative Examples 9 to 16 were tested, and the results are shown in Table 3.

TABLE 3

| | Test No. | Color developer | Sensitizer | Dynamic image density (*1) | Stability of the recorded image (*2) | | | | Stability of the background (*6) | | | |
|---|---|---|---|---|---|---|---|---|---|---|---|---|
| | | | | | Untreated | Moisture Resistance (*3) | Heat Resistance (*4) | Oil Resistance (*5) | Untreated | Moisture Resistance (*3) | Heat Resistance (*4) | Oil Resistance (*5) |
| Ex. 3 | 48 | Zinc p-chlorobenzoate | 1,4-Diethoxy-naphthalene | 1.06 | 1.06 | 0.75 | 1.07 | 1.08 | 0.03 | 0.05 | 0.19 | 0.04 |
| Ex. 4 | 49 | Zinc m-chlorobenzoate | 1,4-Diethoxy-naphthalate | 1.08 | 1.08 | 0.91 | 1.09 | 1.10 | 0.04 | 0.08 | 0.20 | 0.05 |
| CEx. 9 | 50 | Zinc p-chlorobenzoate | None | 0.64 | 0.64 | 0.41 | 0.77 | 0.67 | 0.04 | 0.05 | 0.09 | 0.05 |
| CEx. 10 | 51 | Zinc m-chlorobenzoate | None | 0.69 | 0.69 | 0.56 | 0.84 | 0.78 | 0.05 | 0.08 | 0.12 | 0.10 |
| CEx. 11 | 52 | Zinc p-chlorobenzoate | Benzyl p-benzyl-oxybenzoate | 0.85 | 0.85 | 0.62 | 0.92 | 0.88 | 0.04 | 0.07 | 0.09 | 0.04 |
| CEx. 12 | 53 | Zinc m-chlorobenzoate | Benzyl p-benzyl-oxybenzoate | 0.88 | 0.88 | 0.80 | 0.91 | 0.90 | 0.05 | 0.09 | 0.14 | 0.05 |
| CEx. 13 | 54 | Bisphenol A | 1,4-Diethoxy-naphthalene | 1.24 | 1.24 | 1.08 | 0.90 | 0.32 | 0.03 | 0.07 | 0.14 | 0.05 |
| CEx. 14 | 55 | Bisphenol A | None | 0.85 | 0.85 | 0.81 | 0.79 | 0.18 | 0.07 | 0.13 | 0.13 | 0.09 |
| CEx. 15 | 56 | 3,5-Di-t-butylsalicyclic acid | 1,4-Diethoxy-naphthalene | 1.05 | 1.05 | 1.08 | 1.13 | 1.32 | 0.07 | 0.38 | 0.29 | 1.22 |
| CEx. 16 | 57 | 3,5-Di-t-butyl-salicyclic acid | None | 0.68 | 0.68 | 0.77 | 0.86 | 1.17 | 0.06 | 0.31 | 0.21 | 1.05 |

Ex. and CEx. = Same as the footnote to Tables 1 and 2

Note to Table 3

(*1): Dynamic image density

The density of an image recorded on the thermosensitive recording sheet by a thermosensitive facsimile (KB-4800 made by Tokyo Shibaura Electric Co., Ltd.) with an applied voltage of 18.03 and a pulse width of 3.2 milliseconds was measured by the Macbeth densitometer.

(*2): Stability of the recorded image

The density of an image recorded on the thermosensitive recording sheet by a thermosensitive facsimile (KB-4800 made by Tokyo Shibaura Electric Co., Ltd.) with an applied voltage of 18.03 V and a pulse width of 3.2 milliseconds was measured by the Macbeth densitometer.

(*3): Moisture resistance

The thermosensitive recording sheet was left to stand for 24 hours at 40° C. and 90% RH, and the optical density of its background was measured.

(*4): Heat resistance

The thermosensitive recording sheet was left to stand for 24 hours under drying conditions at 60° C., and the optical density of its background was measured.

(*5): Oil resitance

Castor oil was applied dropwise to the printed colored part, and 10 seconds later, lightly wiped off with filter paper. After standing for 3 days at room temperature, the density of the colored image was measured by the Macbeth densitometer.

(*6): Stability of the background

The optical density of an uncolored portion of the thermosensitive recording sheet was measured by the Macbeth densitometer.

The optical density of an uncolored portion of the thermosensitive recording sheet was measured by the Macbeth densitometer.

EXAMPLE 5

| Dispersion N (dye dispersion) | |
|---|---|
| 3-Diethylamino-6-methyl-7-anilino-fluorane | 1.0 parts |
| 10% Aqueous polyvinyl alcohol solution | 2.3 parts |
| Water | 1.3 parts |
| Dispersion O (dye dispersion) | |
| 3,6,6'-tris(dimethylamino)spiro-[fluorene-9,3'-phthalide] | 1.0 part |
| 10% Aqeuous polyvinyl alcohol solution | 2.3 parts |
| Water | 1.3 parts |
| Dispersion P (color developer dispersion) | |
| Zinc halogen-substituted benzoate (see Table 4) | 6.0 parts |
| 10% Aqueous polyvinyl alcohol solution | 18.6 parts |
| Water | 11.2 parts |

In each run, the dispersions of the above compositions were ground to a particle diameter of 3 microns by an attriter. The following dispersions were mixed in the proportions indicated to form a coating dispersion.

| Dispersion N (dye dispersion) | 4.6 parts |
|---|---|

-continued

| | |
|---|---|
| Dispersion O (dye dispersion) | 4.6 parts |
| Dispersion P (color developer dispersion) | 36 parts |
| Kaolin clay (50% dispersion) | 12 parts |

The coating dispersion was coated on one surface of a substrate paper (basis weight 50 g/m$^2$) at a rate of 6.0 g/m$^2$, and dried. The sheet was treated by a supercalender so that its degree of smoothness became 200 to 300 seconds. The resulting thermosensitive recording sheet adapted to develop a black color was tested for properties. The results are shown in Table 4.

EXAMPLE 6

| Dispersion Q (color developer dispersion) | |
|---|---|
| Other color developer (see Table 4) | 6.0 parts |
| 10% Aqueous polyvinyl alcohol solution | 18.8 parts |
| Water | 11.2 parts |

A thermosensitive recording sheet was prepared in the same way as in Example 5 except that the amount of dispersion P was changed to 18 parts, and 18 parts of dispersion Q was additionally incorporated. The results of testing its properties are shown in Table 4.

COMPARATIVE EXAMPLE 17

A thermosensitive recording sheet was prepared in the same way as in Example 5 except that dispersion Q was used instead of dispersion P. The results of testing its properties are shown in Table 4.

TABLE 4

| | Test No. | Color developer: Halogen-substituted benzoic acid zinc salt | Color developer: Other | Image density (*1): Static (*2) | Image density (*1): Dynamic (*3) | Oil resistance (*4): Untreated | Oil resistance (*4): Treated | Oil resistance (*4): Percent residue (%) | Infared reflectance (%) (*5) |
|---|---|---|---|---|---|---|---|---|---|
| Ex. 5 | 58 | Zinc p-chlorobenzoate | None | 1.09 | 0.65 | 0.61 | 0.74 | 121.3 | 30 |
| | 59 | Zinc m-chlorobenzoate | None | 1.08 | 0.71 | 0.70 | 0.83 | 118.6 | 27 |
| | 60 | Zinc 3,4-dichlorobenzoate | None | 1.20 | 0.85 | 0.80 | 0.97 | 121.3 | 25 |
| Ex. 6 | 61 | Zinc p-chlorobenzoate | Bisphenol A | 1.31 | 0.96 | 0.88 | 0.87 | 98.9 | 32 |
| | 62 | Zinc m-chlorobenzoate | 4,4'-dihydroxy diphenyl sulfone | 1.20 | 0.85 | 0.80 | 0.84 | 105.0 | 28 |
| | 63 | Zinc 3,4-dichlorobenzoate | 4-methyl-4'-hydroxy diphenyl sulfone | 1.30 | 1.00 | 0.98 | 0.96 | 98.0 | 27 |
| CEx. 17 | 64 | None | Bisphenol A | 1.34 | 0.91 | 0.69 | 0.37 | 53.6 | 48 |
| | 65 | None | 4,4'-dihydroxy-diphenyl-sulfone | 0.76 | 0.64 | 0.59 | 0.37 | 62.7 | 49 |
| | 66 | None | 4-Methyl-4'-hydroxydiphenyl sulfone | 1.34 | 0.99 | 0.86 | 0.24 | 27.9 | 58 |

Notes to Table 4
(*1) to (*4): Same as footnote to Tables 1 and 2
(*5): Infrared reflectance (%)

The reflectance of an image recorded on the thermosensitive recording sheet by a bar code printer (TLP-150, a product of F & O) with a pulse width of 4.0 milliseconds and an applied voltage of 30 V was measured by a spectrophotometer (wavelength 800 nm).

What we claim is:

1. A thermosensitive recording sheet having a thermosensitive color developing layer containing a basic leuco dye and an organic color developer, said organic color developer consisting at least partly of a halogen-substituted benzoic acid zinc salt wherein the halogen-substituted benzoic acid zinc salt is selected from the group consisting of zinc p-chlorobenzoate, zinc m-chlorobenzoate and zinc 3,4-dichlorobenzoate.

2. The thermosensitive recording sheet of claim 1 wherein the thermosensitive color developing layers contains the organic color developer in an amount of 0.1 to 5 parts by weight per part by weight of the basic leuco dye.

3. The thermosensitive recording sheet of claim 1 wherein the basic leuco dye is selected from triphenylmethane-type dyes, fluorane-type dyes and azaphthalide-type dyes.

4. The thermosensitive recording sheet of claim 3 wherein the basic leuco dye is a mixture of 3-diethylamino-6-methyl-7-anilinofluorane and 3-(N-cyclohexyl-N-methylamino)-6-methyl-7-anilinofluorane.

5. The thermosensitive recording sheet of claim 1 wherein the basic leuco dye is selected from 3-diethylamino-6-methyl-7-anilinofluorane, 3-(N-cyclohexyl-N-methylamino)-6-methyl-7-anilinofluorane, 3-(N-ethyl-N-isoamyl)amino-6-methyl-7-anilinofluorane and 3-(4-diethylamino-2-ethoxyphenyl)-3-(1-ethyl-2-methylindol-3-yl)-4-azaphthalide.

6. The thermosensitive recording sheet of claim 1 wherein the basic leuco dye is a combination of a fluorene-type leuco dye and a a fluorane-type leuco dye capable of forming a black color.

7. The thermosensitive recording sheet of claim 6 wherein the fluorene-type leuco dye is a leuco dye represented by the following general formula

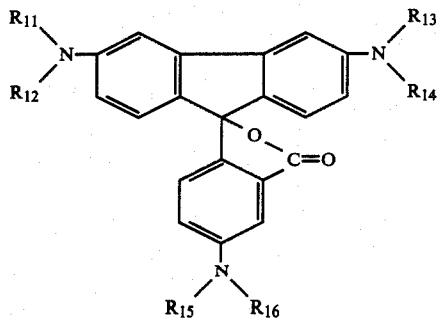

(II)

wherein $R_{11}$, $R_{12}$, $R_{13}$, $R_{14}$, $R_{15}$ and $R_{16}$, independently from each other, represent an alkyl group.

8. The thermosensitive recording sheet of claim 6 wherein the fluorane-type leuco dye is selected from 3-diethylamino-6-methyl-7-anilinofluorane, 3-(N-ethyl-p-toluidino)-6-methyl-7-anilinofluorane, 3-(N-ethyl-N-isoamyl)amino-6-methyl-7-anilinofluorane, 3-diethylamino-6-methyl-7-(o,p-dimethylanilino)fluorane, 3-pyrrolidino-6-methyl-7-anilinofluorane, 3-piperidino-6-methyl-7-anilinofluorane, 3-(N-cyclohexyl-N-methylamino)-6-methyl-7-anilinofluorane, 3-diethylamino-7-(m-trifluoromethylanilino)fluorane, 3-dibutylamino-7-(o-chloroanilino)fluorane, and 3-diethylamino-7-(o-chloroanilino)fluorane.

9. The thermosensitive recording sheet of claim 1 wherein the thermosensitive color developing layer further comprises a sensitizer.

10. A thermosensitive recording sheet having a thermosensitive color developing layer containing a basic leuco dye, a sensitizer, and and organic color developer consisting at least partly of a halogen-substituted benzoic acid zinc salt represented by the following general formula

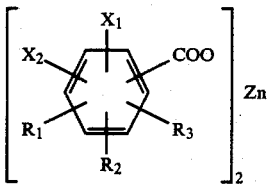

(I)

wherein $X_1$ represents a halogen atom, $X_2$ represents a hydrogen or halogen atom, and $R_1$, $R_2$ and $R_3$, independently from each other, represent a hydrogen atom or an alkyl, alkoxy, cycloalkyl, nitro, cyano or hydroxyl group wherein the sensitizer is a naphthyl ether represented by the following formula

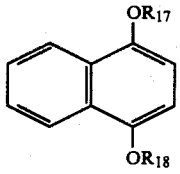

(III)

-continued

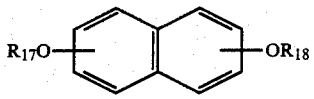

(IV)

wherein $R_{17}$ and $R_{18}$, independently from each other, represent an alkyl, cycloalkyl, phenyl or benzyl group.

11. The thermosensitive recording sheet of claim 10 wherein the sensitizer is included in an amount of 0.5 to 6 parts by weight per part by weight of the dye.

12. The thermosensitive recording sheet of claim 10 wherein the halogen-substituted benzoic acid zinc salt is zinc p-chlorobenzoate, zinc m-chlorobenzoate or zinc 3,4-dichlorobenzoate.

13. The thermosensitive recording sheet of claim 10 wherein the thermosensitive color developing layer contains the organic color developer in an amount of 0.1 to 5 parts by weight per part by weight of the basic leuco dye.

14. The thermosensitive recording sheet of claim 10 wherein the basic leuco dye is selected from triphenylmethane-type dyes, fluorane-type dyes and azaphthalide-type dyes.

15. The thermosensitive recording sheet of claim 10 wherein the basic leuco dye is selected from 3-diethylamine-6-methyl-7-anilinofluorane, 3-(N-cyclohexyl-N-methylamine)-6-methyl-7-anilinofluorane, 3-(N-ethyl-N-isoamyl)-amino-6-methyl-7-anilinofluorane and 3-(4-diethylamine-2-ethoxyphenyl)-3-(1-ethyl-2-methylindol-3-yl)-4-azaphthalide.

16. The thermosensitive recording sheet of claim 15 wherein the basic leuco dye is a mixture of 3-diethylamino-6-methyl-7-anilinofluorane and 3-(N-cyclohexyl-N-methylamino)-6-methyl-7-anilinofluorane.

17. The thermosensitive recording sheet of claim 10 wherein the basic leuco dye is a combination of fluorene-type leuco dye and a fluorane-type leuco dye capable of forming a black color.

18. The thermosensitive recording sheet of claim 17 wherein the fluorene-type leuco dye is a leuco dye represented by the following general formula

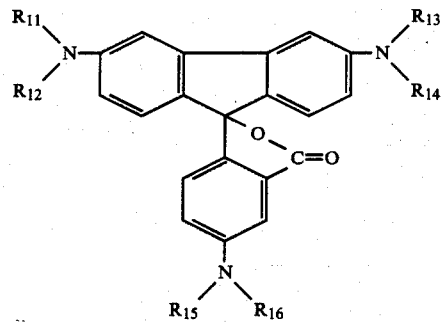

(II)

wherein $R_{17}$ and $R_{18}$, independently from each other, represent an alkyl, cycloalkyl, phenyl or benzyl group.

19. The thermosensitive recording sheet of claim 17 wherein the sensitizer is included in an amount of 0.5 to 6 parts by weight per part by weight of the dye.

* * * * *